United States Patent [19]

Gudde

[11] 4,022,394

[45] May 10, 1977

[54] SPOOL HOLDER APPARATUS

[76] Inventor: Lawrence J. Gudde, 4924 Beatty Drive, Riverside, Calif. 92504

[22] Filed: Dec. 29, 1975

[21] Appl. No.: 644,576

[52] U.S. Cl. ..... 242/129.6; 242/134

[51] Int. Cl.[2] ..... B65H 49/00; B65H 49/18

[58] Field of Search ..... 242/129.5, 129.6, 129.62, 242/134, 136, 141; 112/231, 257; 223/106

[56] References Cited

UNITED STATES PATENTS

| | | | |
|---|---|---|---|
| 988,837 | 4/1911 | Tharp | 242/136 |
| 1,387,299 | 8/1921 | Oliver | 242/129.62 |
| 2,036,035 | 3/1936 | Giallanza | 242/129.6 |

*Primary Examiner*—Leonard D. Christian
*Attorney, Agent, or Firm*—Harvey S. Hertz

[57] ABSTRACT

Spool holder apparatus for positioning a spool of thread in a generally horizontal plane on a sewing machine head. The spool holder apparatus base has a pair of vertically extending arms extending therefrom. A spool holder is formed of an elongated member secured at its ends to said vertically extending arms, respectively, and has an axis perpendicular to said arms. Securing means are provided for attaching the base to the machine.

2 Claims, 4 Drawing Figures

FIG. 1
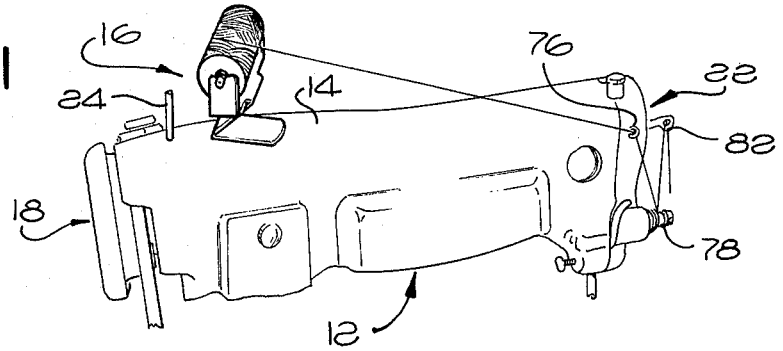
FIG. 3b
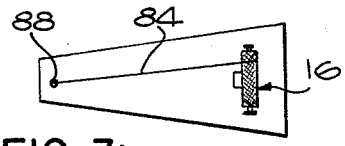
FIG. 3a
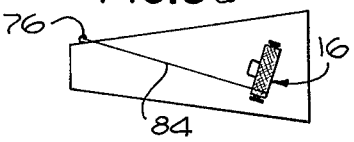
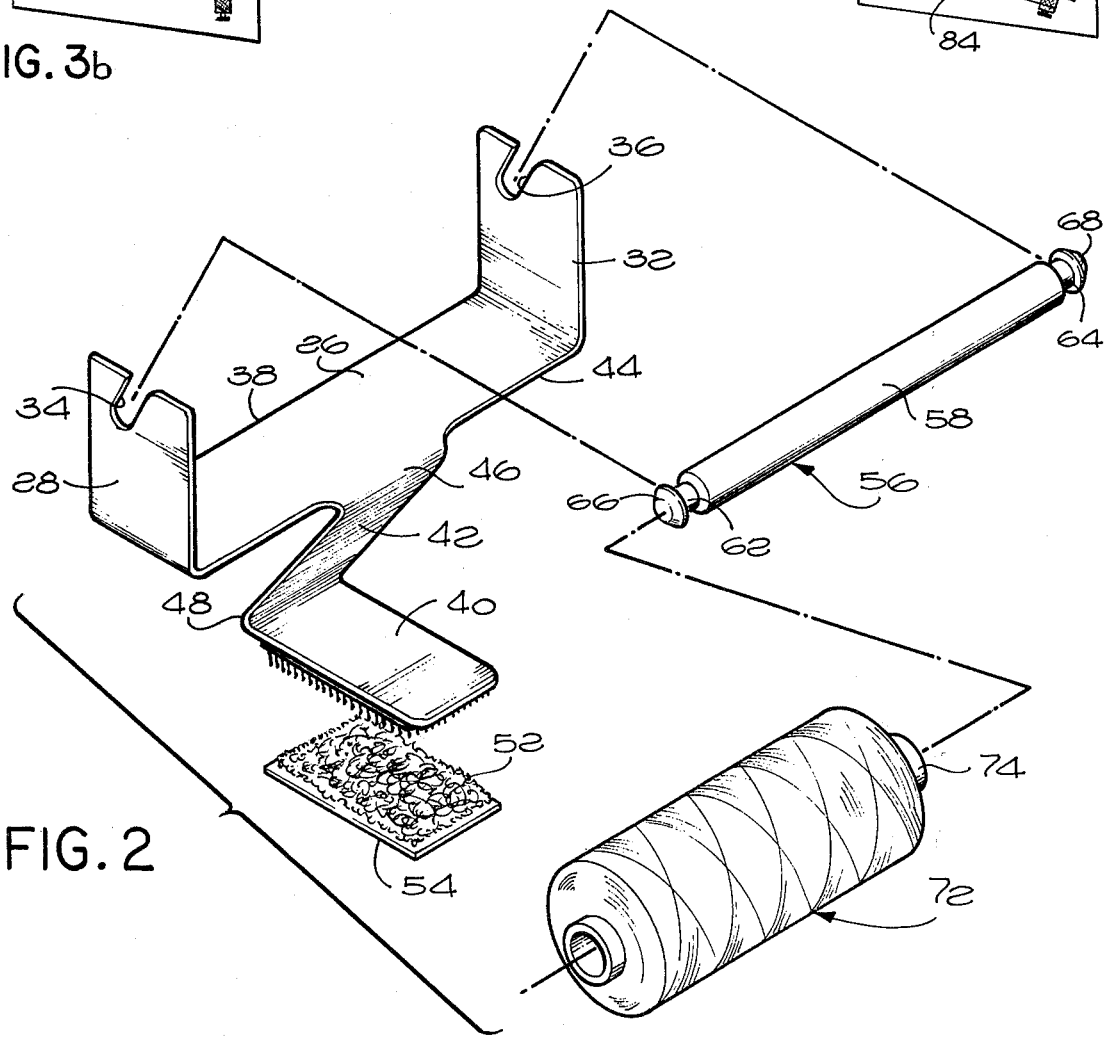
FIG. 2

SPOOL HOLDER APPARATUS

BACKGROUND OF THE INVENTION

1. Field of the Invention

The field of art to which the invention pertains includes the field of spool holder apparatus for sewing machines, particularly, a spool holder apparatus for securing a spool of thread in a horizontal plane on a sewing machine head.

2. Description of the Prior Art

Conventional thread spool holder spindles are positioned so that the spool of thread can be mounted on the sewing maching head in a vertical positon and is freely moveable along the vertical axis of the spindle. In such arrangements the thread is normally wound on the spool in continuous planes perpendicular to the axis of the spool. As the thread is unwound from the spool, the proper tension is provided by the tension unit of the machine. However, when the thread is wound on a light weight spool, such as styrofoam, it is found that the spool and the thread move along the vertical axis of the spindle causing tension changes in the thread which cannot be compensated for in the sewing machine tension unit. Thus, it has been found that the thread will continuously break causing large amounts of down time for the sewing machine operator. Additionally, where the thread is wound on a spool in planes which intersect the axis of the spool at varying angles, there is a continuous tension change on the thread which cannot be compensated for by the sewing machine tension unit. These tension changes also result in thread breakage and the resultant down time of the machine.

The present invention provides apparatus for mounting a spool of thread in a horizontal plane minimizing tension changes as the thread is fed from the spool to the tension unit of the sewing machine. The present invention enables all types of thread and spools to continuously flow to the tension unit of the sewing machine without restriction. Thread tension changes are minimized and the apparatus can be used in combination with all types of sewing machines.

SUMMARY OF THE INVENTION

Apparatus for positioning a spool of thread in a generally horizontal plane on a sewing machine head. A base has a pair of vertically extending arms extending therefrom. A spool holder is formed of an elongated member secured at its ends to said arms, respectively, and has an axis perpendicular to the plane of the arms. Securing means are provided for attaching the base to the machine head.

The advantages of this invention, both as to its construction and mode of operation, will be readily appreciated as the same becomes better understood by reference to the following detailed description when considered in connection with the accompanying drawings in which like reference numerals designate like parts throughout the figures.

BRIEF DESCRIPTION OF THE DRAWINGS

FIG. 1 is a perspective view illustrating the spool holder apparatus mounted on a sewing machine;

FIG. 2 is an exploded perspective view of the spool holder apparatus of the invention; and FIGS. 3(*a*) and 3(*b*) schematically illustrated alternative mounting positions on various types of sewing machines.

DESCRIPTION OF THE PREFERRED EMBODIMENTS

Referring now to the drawings, there is shown in FIG. 1 a sewing machine head 12 of conventional design. Mounted on the sewing machine head top surface 14 is a spool holder apparatus 16 constructed in accordance with the principles of the invention. The spool holder apparatus 16 is mounted on the head top surface 14 intermediate the balance wheel end 18 and the thread take up end 22 of the machine. The spool holder apparatus 16 is normally mounted adjacent the vertical spindle 24 which can be retained on the sewing machine head for future use is desired.

Referring now to FIG. 2 the spool holder apparatus 16 is shown in greater detail and comprises a horizontal base plate 26 formed in a horizontal plane and having a pair of vertically extending arms 28 and 32 extending upwardly from either end of the base plate. A pair of angled slots 34 and 36 are formed in the vertically extending arms and extend from the top surface of the arms at an angle in a direction toward the rear edge 38 of the base plate 26 and the arms 32 and 34.

A mounting plate 40 is normally secured to the top surface 14 of the sewing machine head in a manner which will be described in greater detail hereinafter. A spring member 42 is integrally formed at one end with the front edge 44 of the horizontal base plate 26 and at its other end to the rear edge of the mounting plate 40. The spring member 42 extends downwardly to form an acute angle with the horizontal base plate 26 and the mounting plate 40 and is joined thereto at spring member 42 curved surfaces 46 and 48, respectively.

While the mounting plate 40 could be fastened by means of screws to the machine head top surface 14, it has been found that a preferable technique is to permanently affix a velcro pad 52 to the machine head top surface 14 by means of an adhesive layer 54. Normally the velcro pad 52 has the same dimensions as the bottom surface of the mounting plate 40. Then the spool holder apparatus can be attached to or removed from the sewing maching head 12 at will, as the bottom surface of the mounting plate 40 adheres to the velcro pad 52.

A spool holder 56 is removably mounted in the slots 34 and 36 of the vertically extending arms 28 and 32, respectively. The spool holder is formed of an enlarged central rod 58 whose length is normally greater than the length of a spool which is positioned thereon. In addition, the diameter of the rod 58 is normally less than the opening in the spool enabling the spool to freely rotate thereon. Extending along the axis of the rod 58 from opposite ends thereof are a pair of reduced diameter tips 62 and 64, respectively. A pair of enlarged collars 66 and 68 are attached to the free ends of each of the tips 62 and 64, respectively. The dimension of the spool holder 56 is such that the tips 62 and 64 will be positioned in the slots 34 and 36, respectively, when the spool holder is positioned between the vertically extending arms 28 and 32. Simultaneously, the collars 66 and 68 will be on the exterior side surface of the vertically extending arms 28 and 32, respectively.

The spool of thread 72 having a central spool cylinder 74 is normally positioned on the cylindrical rod 58 prior to mounting the spool on the spool holder 56. Referring again to FIG. 1, once the spool 72 is positioned on the spool holder 56, the thread then can be fed to a thread guide 76 positioned on the sewing machine head adjacent the thread take up end 22. Then, as is conventional, the thread is fed through an upper tension unit 78 to the thread take up 82. The thread 84 wound on the spool cylinder 74 intersects the axis of the spool 74 at continuously varying angles. As can be seen in FIG. 3(*a*), the spool holder apparatus 16 is positioned so that the axis of the spool 74 is substantially perpendicular to the thread feed axis as the thread 84 is unwound from the spool 74 and is fed to the thread guide. This positioning of the thread spool 74 minimizes tension changes in the thread as it feeds off the spool 74 in various changing directions due to the angular winding of the thread on the spool. FIG. 3(*b*) illustrates a different mounting position of the spool holder apparatus where a thread guide 88 is positioned in the top center of the machine head.

It should be noted that the spring member 42 connecting the mounting plate 40 and the horizontal base plate 26 enables the spool holder to flex sufficiently as the thread is fed off the spool minimizing thread breakage.

While the spool holder 56 has been shown as being removable from the vertically extending arms 28 and 32, it should be understood that one end of the spool holder 56 could be pivotably attached to one of the vertically extending arms and the other end of the spool holder could be made removable for changing spools of thread.

I claim:

1. Apparatus for positioning a spool of thread in a generally horizontal plane on a sewing machine head comprising:

a base having a pair of vertically extending arms;

a spool holder formed of an elongated member secured at its ends to said arms, respectively, and having an axis perpendicular to said arms;

means for securing said base to said machine including a spring enabling the base to flex with respect to said securing means, and a mounting plate removably secured to said machine head, said spring interconnecting said base and said mounting plate.

2. Apparatus in accordance with 1 wherein a velcro pad is provided for attaching said mounting plate to said machine.

* * * * *